United States Patent [19]

Kudo

[11] Patent Number: 4,654,894

[45] Date of Patent: Apr. 7, 1987

[54] SWIMSUIT

[75] Inventor: Kazunori Kudo, Tokyo, Japan

[73] Assignee: Kabushiki Kaisha Tokyo Fashion, Tokyo, Japan

[21] Appl. No.: 885,682

[22] Filed: Jul. 15, 1986

[51] Int. Cl.[4] ..... A41D 5/00

[52] U.S. Cl. ..... 2/67; 128/467

[58] Field of Search ..... 2/67, 400, 401, 406; 128/425, 467

[56] References Cited

U.S. PATENT DOCUMENTS

| | | | |
|---|---|---|---|
| 4,289,137 | 9/1981 | Dell et al. | 2/67 |
| 4,343,044 | 8/1982 | Borda et al. | 2/67 |
| 4,414,691 | 11/1983 | Estruch | 2/67 |

*Primary Examiner*—Doris L. Troutman

[57] ABSTRACT

This invention relates to a swimsuit, and this swimsuit consists of a brassiere in the upper part and a shorts type bottom section in the lower part, to the reverse side of the above-mentioned bottom part is sewn a mesh cloth covering the whole area, to the above-mentioned mesh cloth on the reverse side of the front center part of the aforesaid bottom section is sewn a retaining cloth consisting of a vertically elastic mesh cloth, to the reverse side in the lower section behind the aforesaid bottom section is sewn a hip lift cloth, around the leg holes of the above-mentioned bottom part is sewn shirring tapes, and to the reverse side in the lower center behind the aforesaid bottom section is sewn a shirring tape in the vertical direction.

1 Claim, 4 Drawing Figures

SWIMSUIT

BACKGROUND OF THE INVENTION

This invention relates to a swimsuit possessing the function of an underwear as well as the function of keeping and improving the shape of the body of the person wearing the swimsuit.

Swimsuits of different material and of different designs have conventionally been proposed. In general, in wearing such swimsuits, in most cases supporters are worn underneath the swimsuit. In wearing a swimsuit that calls for use of a supporter, however, in addition to the inconvenience of wearing the supporter when ever using the swimsuit, there was a drawback that part of the supporter can show from outside the swimsuit. Furthermore, when a number of swimsuits are owned by one person and if one of such swimsuits is largely different from the balance in design, since one supporter will not be applicable to all the swimsuits, there was inconvenience of the necessity for providing supporters being compatible with the design of each swimsuit, with requirements for spending additional expense therefor.

DETAILED DESCRIPTION OF THE INVENTION

The object of this invention is to provide with a swimsuit being capable of solving the above-mentioned problems by using a supporter, and another object is to offer a swimsuit provided with the functions of an underwear and of keeping and improving the shape of the body of the person wearing the swimsuit.

The characteristics of this invention are that it is composed of a brassiere section in the upper part and a shorts type bottom section in the lower part, that all over the reverse side of the above-mentioned bottom section is sewn a mesh cloth, that to the mesh cloth on the reverse side of the front center section of the above-mentioned bottom part is sewn a retaining cloth consisting of a vertically elastic mesh cloth, that to the reverse side of the lower part in the back of the above-mentioned bottom section is sewn a hip lift cloth consisting of a mesh cloth, that around the leg holes in the aforesaid bottom section are sewn shirring tapes, and that to the reverse side of the center of the lower part in the back of the above-mentioned bottom section is sewn a shirring tape in the vertical direction in such a way that it may reach the waist line and the hip lift cloth as well.

The characteristics of this invention may be better understood when described by referring to the following drawings.

BRIEF DESCRIPTION OF THE INVENTION

DETAILED DESCRIPTION OF THE PREFERRED EMBODIMENTS

Figure 1:
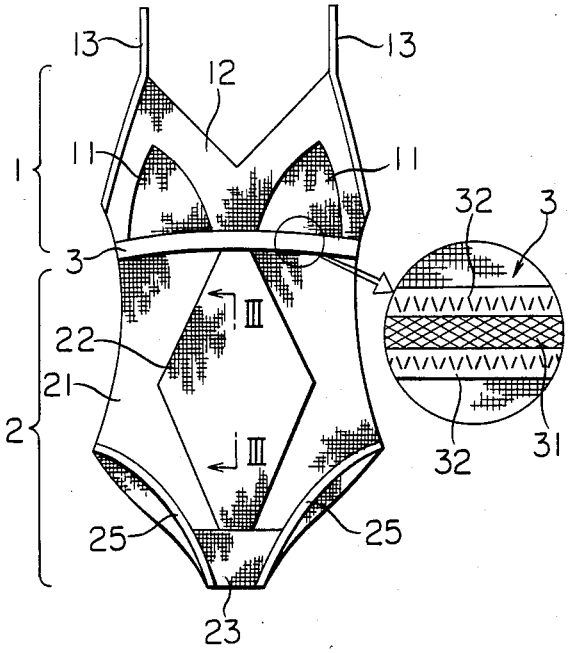
FIG. 1 is a front view of the swimsuit that has been turned inside out.

In FIG. 1, the swimsuit consists of the brassiere section 1 in the upper part and the shorts type bottom section 2 in the lower part, and on the front side of the swimsuit is provided an under bust line 3 along the border line between the brassiere section and the bottom section.

On both sides of the reverse side of the brassiere section 1 in the upper part are provide with shaped cups 11, 11, and these shaped cups have been formed by heat treating polyurethane. At the top of the upper edge section 12 in the brassiere section 1 are provided with shoulder straps 13,13.

Figure 3:
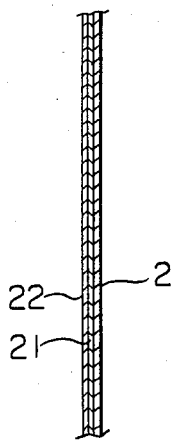
FIG. 3 is an enlarged cross sectionan view of line III—III in FIG. 1.
Figure 2:
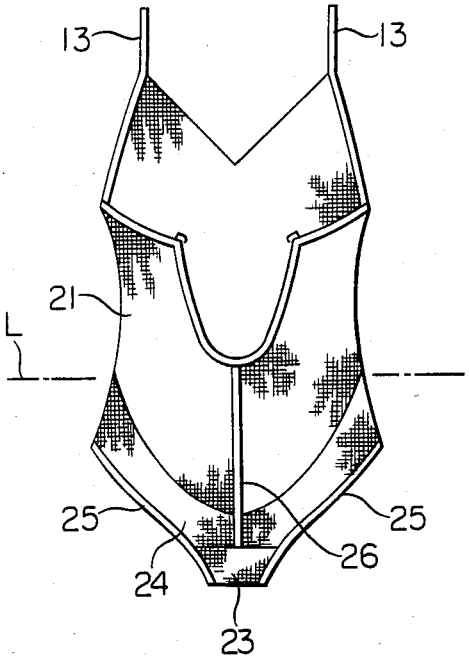
FIG. 2 is a rear view of FIG. 1.

All over the reverse side of the bottom section 2 is sewn a mesh cloth 21 as illustrated in FIGS. 1 through 3. The function of this mesh cloth is for keeping and improving the shape of the body. One example of such mesh cloth in use ia 48 gauge and 280 dinir. Furthermore, on the reverse side of the center part on the front side of the bottom section 2 is sewn over the mesh cloth 21 (the left side of FIG. 3) a retaining cloth 22 consisting of a vertically elastic mesh cloth.

The retaining cloth 22 is cut into a diamond shape as shown in FIG. 1, its upper edge is made to reach the under bust line 3 and its lower edge is made to reach the crotch section 23. While the swimsuit is worn, the retaining cloth 22 plays the role of suppressing the abdomen from bulging out. Jointly with the mesh cloth 21, this retaining cloth well displays the function of keeping and improving the shape of body.

Figure 4:
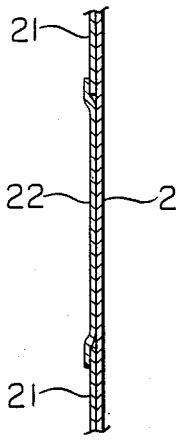
FIG. 4 is a cross sectional view illustrating a different example of a method of setting the retaining cloth.

For setting the retaining cloth 22, the whole area of the bottom side may be attached to the upper surface of the mesh cloth 21 as shown in FIG. 3, whereas it may be sewn in such a way that the retaining cloth may form one same plane with the mesh cloth 21 as illustrated in FIG. 4. While the cross section of the fiing part of the retaining cloth 22 is of a three-layer construction (FIG. 3) in the former case, it is of a two-layer construction (FIG. 4) in the latter case.

The crotch section 23 is a vrotch cloth. Further, a punch may be provided using a mesh cloth in this crotch section, so that a sanitary napkin may be placed therein.

As illustrated in FIG. 2, moreover, in the rear lower part of the bottom section 2, a hip lift cloth 24 consisting of an almost V-shape mesh cloth is sewn to the mesh cloth 21, extending from the croth section 23 in the bottom up to the waist line L in its upper end.

Around the leg holes in bottom section 2, furthermore, shirring tapes 25 are sewn, and these tapes, while the swimsuit is worn, provided roundness to the buttocks and snuggly fit the swimsuit to the buttocks as well. A shirring tape 26 is sewn, to the reverse side in the center of the rear lower part of the bottom section 2, in a vertical direction. The lower end of this shirring tape 26 goes through the hip lift cloth 24 and extends as far as the crotch section 23, and its upper end goes as far as the waist line L. This shirring tape 26 plays the role of helping the hip lift cloth 24 further display its hip lifting function.

In order to allow the arms to move around freely, the under bust line 3, as illustrated in a partially enlarged view in FIG. 1, is a freely elastic cloth which is composed of rubber cloths 32, 32 positioned over and underneath a mesh 31.

What I claim is:

1. A swimsuit comprising a brassiere section in the upper part and a shorts type bottom section in the lower part, a mesh cloth being sewn all over the area on the reverse side of the bottom section, a retaining cloth consisting of a vertically elastic mesh cloth being vertically sewn to the mesh cloth on the reverse side on the front center section of the bottom section, a hip lift cloth made of a mesh cloth being sewn on the reverse side in the lower part behind the bottom part, shirring tapes being sewn around leg holes in the bottom section, and a shirring tape being sewn on the reverse side in the lower center part behind the bottom part and in the vertical direction in such a way that its upper and lower ends can be allowed to reach a waist line as well as the hip lift cloth.

* * * * *